US007167193B2

(12) United States Patent
Goetzke et al.

(10) Patent No.: US 7,167,193 B2
(45) Date of Patent: Jan. 23, 2007

(54) ACTIVE COOLING SYSTEM FOR LASER IMAGER

(75) Inventors: Donald J. Goetzke, Woodbury, MN (US); Bradley B. Rassatt, Apple Valley, MN (US); James E. Steffen, Woodbury, MN (US); David J. McDaniel, Vdnais Heights, MN (US)

(73) Assignee: Eastman Kodak Company, Rochester, NY (US)

( * ) Notice: Subject to any disclaimer, the term of this patent is extended or adjusted under 35 U.S.C. 154(b) by 334 days.

(21) Appl. No.: 10/376,561

(22) Filed: Feb. 28, 2003

(65) Prior Publication Data

US 2004/0170940 A1 Sep. 2, 2004

(51) Int. Cl.
*B41J 2/375* (2006.01)

(52) U.S. Cl. ..... 347/223

(58) Field of Classification Search ..... 347/223, 347/222, 171, 312; 355/30; 432/59, 228, 432/233; 360/315

See application file for complete search history.

(56) References Cited

U.S. PATENT DOCUMENTS

| | | | | |
|---|---|---|---|---|
| 3,914,097 | A | 10/1975 | Wurl | |
| 4,545,671 | A | 10/1985 | Anderson | |
| 5,221,200 | A * | 6/1993 | Roztocil et al. | 432/59 |
| 5,357,388 | A * | 10/1994 | Smith | 360/315 |
| 5,519,429 | A * | 5/1996 | Zwijsen et al. | 347/223 |
| 5,557,388 | A | 9/1996 | Creutzmann et al. | |
| 5,563,681 | A * | 10/1996 | Kirkwold et al. | 355/30 |
| 5,699,100 | A | 12/1997 | Fukuda et al. | |
| 5,699,101 | A | 12/1997 | Allen | 347/212 |
| 6,041,516 | A * | 3/2000 | Preszler et al. | 34/392 |
| 6,344,869 | B2 * | 2/2002 | Sasaki et al. | 347/222 |

* cited by examiner

*Primary Examiner*—K. Feggins
(74) *Attorney, Agent, or Firm*—William F. Noval

(57) ABSTRACT

An apparatus for cooling thermally processed media exiting from a thermal processor comprising: a heat conductive member which has first and second opposite sides which is positioned to receive media from a thermal processor, and which removes heat from the heated media as it passes over the first side of the member; and means for removing heat from the member by passing air in contact with and past the second side of the member to remove heat from the member.

8 Claims, 3 Drawing Sheets

ACTIVE COOLING SYSTEM FOR LASER IMAGER

FIELD OF THE INVENTION

This invention relates in general to imaging systems and more particularly to an active cooling system for cooling thermally processed media after development by a heated member in an imaging system

BACKGROUND OF THE INVENTION

Thermally processed media are widely used in a variety of applications, such as in the medical, industrial and graphic imaging fields. For example, medical laser imagers reproduce diagnostic images on thermally processed photothermographic film. After exposure, the film is thermally developed by means of a heated member, such as a rotatable heated drum. Subsequently, the developed media is cooled to prevent over development of the image and to allow a user to hold the media while examining the developed image.

During the cooling process, it is important to cool the media uniformly to avoid image artifacts that could interfere with diagnosis. Film cooling is also required to protect various electronics components in the laser imager from overheating. Various active cooling systems have been proposed using forced convection where moving air directly contacts the heated media. (See: U.S. Pat. No. 5,557,388, issued Sep. 17, 1996, inventors Creutzmann et al.; U.S. Pat. No. 3,914,097, issued Oct. 21, 1975, inventor Wurl; U.S. Pat. No. 4,545,671, issued Oct. 8, 1985, inventor Anderson; U.S. Pat. No. 5,221,200, issued Jun. 22, 1993, inventors Roztocil et al.). These systems present problems resulting from uneven cooling which produces image artifacts.

A passive cooling system has also been used with great success. As disclosed in U.S. Pat. No. 5,563,681, issued Oct. 8, 1996, inventors Kirkwold et al., and U.S. Pat. No. 5,699,101 issued Dec. 16, 1997, inventor Allen, this system included a plate positioned adjacent the exit of a heated drum processor. In one arrangement, the plate has a first region adjacent the exit from the heated drum of thermally insulative material and a second successive region of thennally conductive material. In another arrangement, the plate has a textured and/or perforated top surface positioned relative to the heated drum so that the media slides on the top surface. Although the passive cooling systems disclosed in the latter two patents are successful for their intended purposes, in laser imager producing film at rates of 160 images per hour or more such systems are unable to handle the substantial increase in heat generated. The high throughput requires the cooling system to absorb proportionately more heat per unit of time, before the film encounters components in the imager that might produce image artifacts by non-uniformly cooling the film.

There is thus a need for a cooling system in high throughput laser imagers which maintains excellent image quality by uniformly cooling heated media processed by the laser imager.

SUMMARY OF THE INVENTION

According to the present invention, there is provided a solution to the problems discussed above.

According to a feature of the present invention, there is provided an apparatus for cooling thermally processed media exiting from a thermal processor comprising: a heat conductive member which has first and second opposite sides which is positioned to receive media from a thermal processor, and which removes heat from said heated media as it passes over said first side of said member; and means for removing heat from said member by passing are in contact with and past said second side of said member to remove heat from said member.

ADVANTAGEOUS EFFECT OF THE INVENTION

The invention has the following advantages.

1. A laser imager producing thermally processed media can operate at higher throughput, while maintaining excellent image quality.

2. The objective of Par. 1 is achieved by maximizing the heat transfer from the media via conduction and isolating the convective heat transfer from the media.

3. The invention uses an acceptable input power requirement; occupies a small space; is reasonably easy-to-service components.

DETAILED DESCRIPTION OF THE INVENTION

Figure 1:
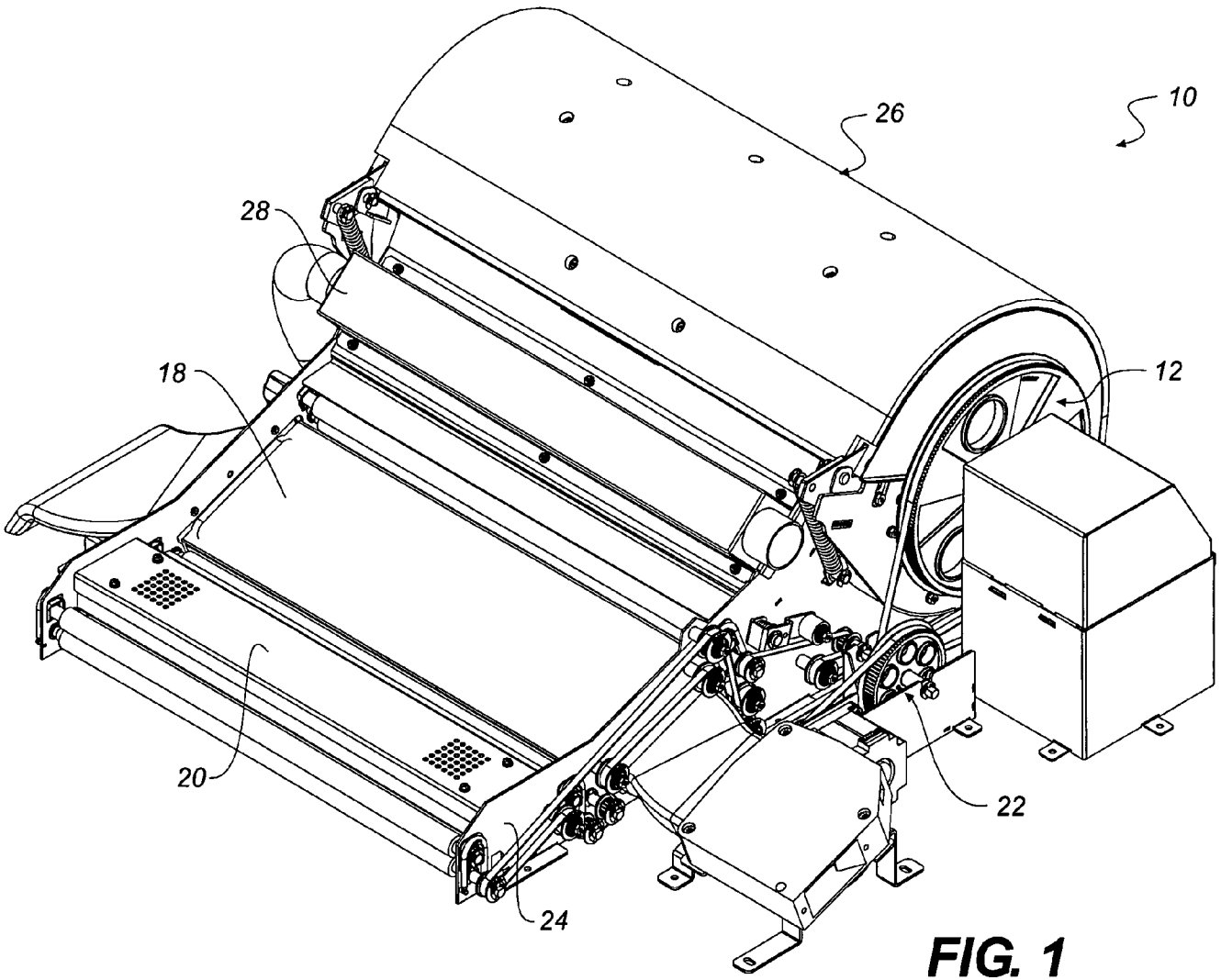
FIG. 1 is a perspective view of a laser imager thermal processor incorporating the present invention.
Figure 2:
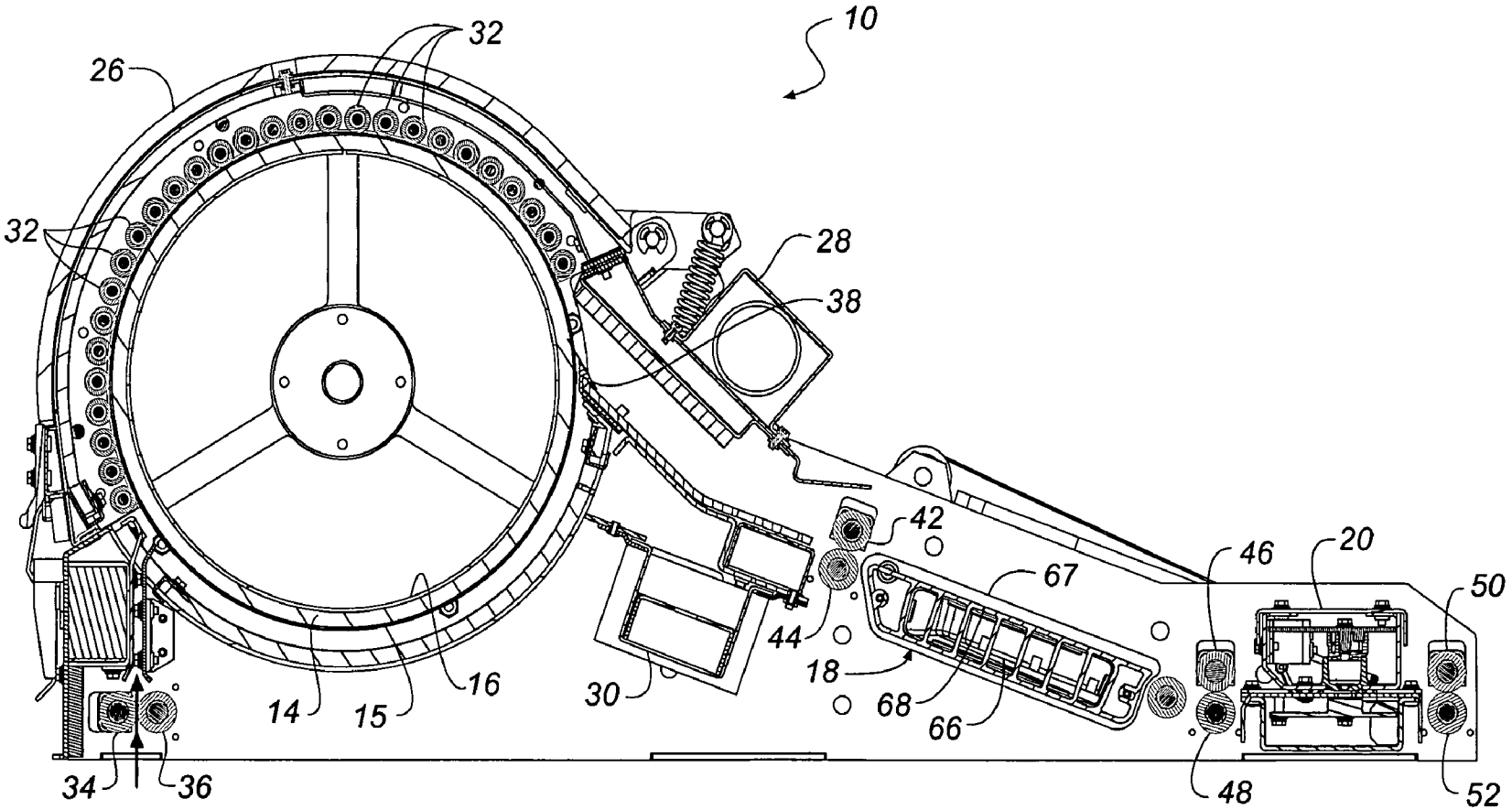
FIG. 2 is a side elevational view of the thermal processor of FIG. 1.

Referring now to FIGS. 1 and 2 there is shown an exemplary thermal processor of a laser imager incorporating an embodiment of the present invention. As shown, thermal processor 10 includes a main drum assembly 12 having a rotatably mounted heated drum 14 having an outer resilient layer 15. Drum 14 is heated with an electrical heater 16 applied to the inner surface of drum 14. The electrical heater is divided into a plurality of electrical heater zones across the width of the drum to minimize optical density variations in the cross media direction. Processor 10 also includes a cooling section 18 according to the invention, densitometer 20, drive train 22, chassis member 24, cover assembly 26 and condensation traps 28, 30. Rollers 32 hold an exposed film in contact with drum 14.

In operation, exposed film is fed by roller pair 34, 36 into contact with drum 14, rollers 32 holding film in contact with heated drum 14. Drum rotational velocity, drum diameter, and film wrap on drum 14 determine drum dwell time. Thermal processor 10 is configured to process up to 160 images per hour for 35×43 cm. film.

Film is stripped from drum 14 by stripper 38 which directs the heated film along an exit path over cooling section 18. Roller pairs 42, 44, 46, 48 and 50, 52 transport the film along the exit path to an output tray past densitometer 20.

Figure 3:
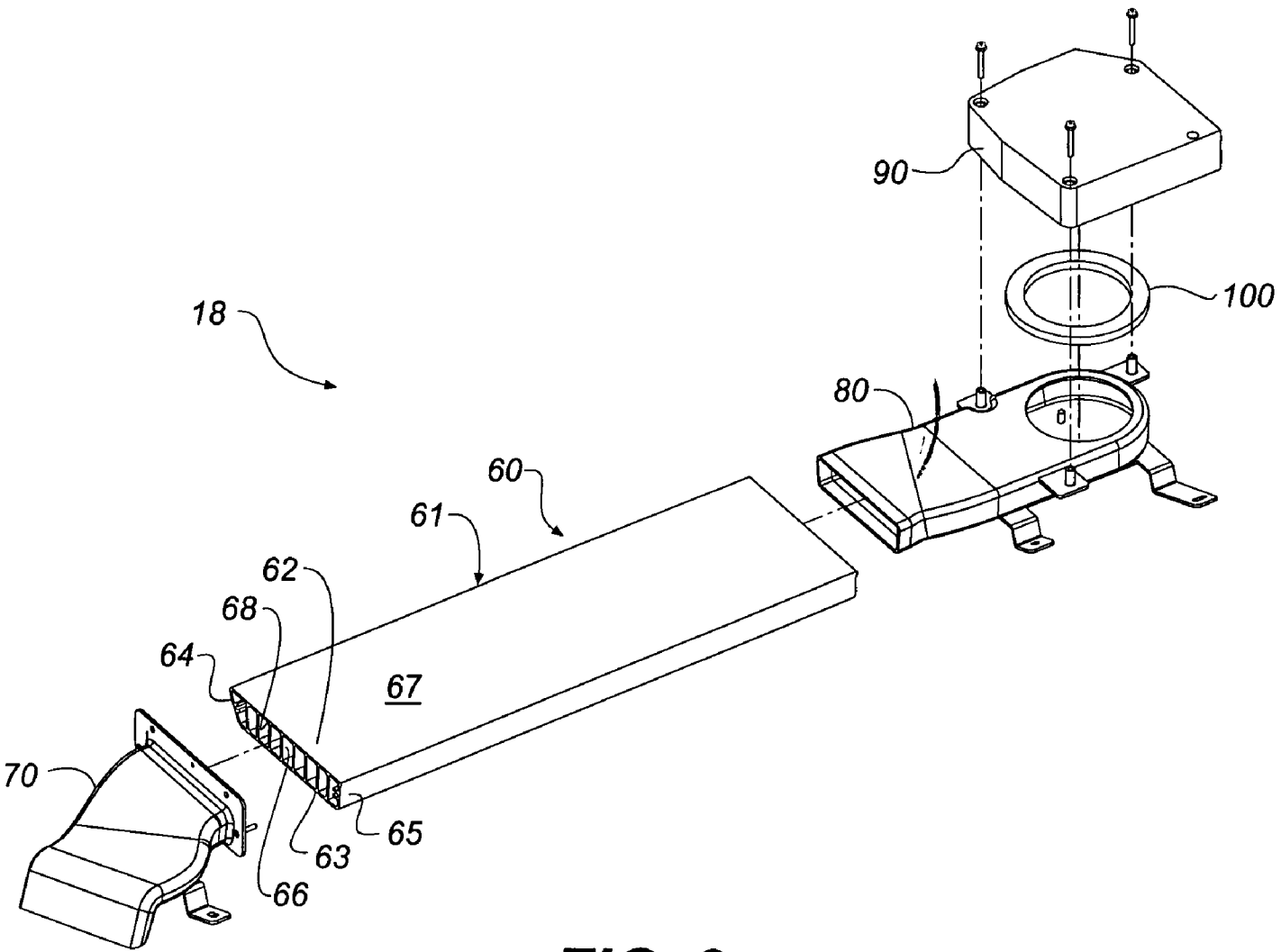
FIG. 3 is an exploded view of an embodiment of the present invention.

Referring now more particularly to FIG. 3, there will be described in greater detail cooling section 18 according to an embodiment of the present invention. Cooling section 18 includes heat sink 60, inlet duct 70, outlet duct 80, and fan 90. Heat sink 60 includes a rectangular, extruded tubular part 61 having upper member 62, lower member 63, side members 64, 65 and internal fins 66. Part 61 is made of heat conductive material such aluminum, or other metal, heat conductive polymer or the like. The upper side 67 of member 62 is smooth and free of defects to avoid scratching the warm film.

Internal fins 66 contact lower side 68 of member 62 and provide maximum surface area for convective heat transfer from member 62 to the air flowing through part 61.

The inlet duct 70 is preferably a blow molded rectangular, tubular plastic part. It directs the cooling air from outside of the front of the imager to the inside of the heat sink, preventing any air flow from occurring near the warm film.

The outlet duct 80 is also preferably a blow molded rectangular, tubular plastic part. It directs the cooling air from the heat sink 60 to the fan 90, preventing any air flow from occurring near the warm film.

The fan 90 meets a minimum air flow requirement, in order to provide sufficient cooling and minimize cross-web temperature variation in the heat sink 60. It draws minimum electrical power. Its form factor is of a reasonable size, which allows it to fit into the space allowed near the imager back panel. The outlet of the fan directs the air through the imager back panel to the rear of the imager.

Gaskets 100 are installed in between each part in the active cooling system 18, to prevent air from leaking out of the cooling system to the volume under the hood. The gaskets 100 that seal the heat sink 60 to the processor chassis are made of closed-cell silicone so that they can withstand the higher temperatures that the heat sink experiences.

Important parameters of the cooling section design include the following:

Heat Removal Rate

The cooling section 18 must remove enough heat from the film to prevent the film from over heating the densitometer 20 and output electronics. The densitometer 20 must remain at preferably less than 75 C. The heat removal rate is primarily determined by two parameters: the efficiency of the heat transfer between the film and the aluminum top plate 62, and the amount of heat convection from the aluminum plate 62 and fins 66 to the air moving through the box. The design is limited by the convection to the air.

Top Plate Material

The cooling system top plate 62 is made of aluminum, because aluminum is an excellent heat conductor. At the same time, aluminum is reasonably priced, relative to materials that are better heat conductors than aluminum. It will be understood that other heat conductive materials can be used including other metals, heat conductive polymer or the like.

Film Contact Surface Shape

The cooling section top plate 62 is flat.

Top Plate Surface Coating

The top surface 67 of the top plate 62 must be very smooth in order to avoid scratching the film. The top plate 62 preferably uses a Fluoropolymer coating (Perfluoroalkoxy) in order to minimize film scratching.

Duct Design

The ducts and cooling box are designed to minimize pressure drops that would impeded air flow in the system, thus maximizing the heat removed. Therefore, the design avoids sharp changes in direction and in cross-sectional area through the air flow path.

Fan Performance

The performance of the cooling section fan must balance many factors. First and foremost, it must provide enough air flow to adequately remove the heat transferred from the film to the top plate. However, it must run on low voltage and draw minimal current, to avoid overloading the electrical system. It must have a lifetime greater than the imager's lifetime. It must be small enough to fit within the space available between the processor chassis and the back panel. It must be quiet enough to allow the imager to pass the noise specification. It must not produce vibrations that affect the performance of the optics subsystem.

The invention has been described in detail with particular reference to certain preferred embodiments thereof, but it will be understood that variations and modifications can be effected within the spirit and scope of the invention.

PARTS LIST

10 thermal processor
12 main drum assembly
14 heated drum
15 resilient layer
16 electrical heater
18 cooling section
20 densitometer
22 drive train
24 chassis member
26 cover assembly
28,30 condensation traps
32,34,36 rollers
38 stripper
42,44,46,48,50,52 roller pairs
60 heat sink
61 extruded tubular aluminum part
62 upper surface member
63 lower member
64,65 side members
66 internal fins
67 upper side
68 lower side
70 inlet duct
80 outlet duct
90 fan
100 gaskets

What is claimed is:

1. An apparatus for cooling thermally processed media exiting from a thermal processor comprising:

a solid heat conductive member which has a first side positioned to receive media from a thermal processor, and which removes heat from said heated media as it passes over said first side of said heat conductive member; and an air mover for removing heat from said heat conductive member by passing air in contact with and past a second side of said heat conductive member to remove heat from said heat conductive member, said second side being opposite said first side; while preventing any air flow from occurring near the heated media.

2. The apparatus of claim 1 wherein said member forms a side of an enclosed duct through which said air is passed.

3. The apparatus of claim 1 wherein said member has a plurality of heat conductive fins mounted on the second side thereof to aid in the diffusion and rapid transfer of heat from said first side of said member.

4. The apparatus of claim 1 wherein said air mover for removing heat includes a fan assembly for drawing air into contact with and past said second side of said member.

5. An apparatus for the thermally processing a sheet of thermally processable material, comprising:

a heated member for heating a thermally processable media moved into contact with said heated member;

a solid heat conductive member which has a first side positioned to receive media from said heated member, and which removes heat from said heated media as it passes over said first side of said heat conductive member; and an air mover for removing heat from said heat conductive member by passing air in contact with and past a second side of said heat conductive member to remove heat from said heat conductive member, said second side being opposite said first side; while preventing any air flow from occurring near the heated media.

6. A method for cooling thermally processed media exiting from a thermal processor comprising:

receiving heated media from the thermal processor;

directing the heated media over a first side of a solid heat conductive member to remove heat from the heated media as it passes over the first side of the member; and passing air in contact with and past a plurality of heat conductive fins mounted on a second side of the heat conductive member to remove heat from the heat conductive member, the second side being opposite the first side; while preventing any air flow from occurring near the heated media.

7. An apparatus for cooling thermally processed media exiting from a thermal processor, comprising:

a solid heat conductive member which has a first side positioned to receive heated media from a thermal processor, and which removes heat from the heated media as the heated media passes over the first side of the heat conductive member;

a plurality of heat conductive fins mounted on a second side of the heat conductive member, the second side being opposite the first side, to aid in the diffusion and transfer of heat from the first side of the heat conductive member; and a fan assembly for drawing air into contact with and past the second side of the heat conductive member to remove heat from said heat conductive member;

while preventing any air flow from occurring near the heated member.

8. The apparatus of claim 7, wherein the heat conductive member forms a side of an enclosed duct through which the air is passed.

* * * * *